US012698929B2

(12) United States Patent
Hu et al.

(10) Patent No.: US 12,698,929 B2
(45) Date of Patent: Aug. 4, 2026

(54) OIL SEPARATION DEVICE FOR CONDENSER, CONDENSER HAVING IT AND REFRIGERATION SYSTEM

(71) Applicant: Carrier Corporation, Palm Beach Gardens, FL (US)

(72) Inventors: Yongliang Hu, Shanghai (CN); Zhizhong Xiang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 126 days.

(21) Appl. No.: 18/436,113

(22) Filed: Feb. 8, 2024

(65) Prior Publication Data

US 2024/0271842 A1 Aug. 15, 2024

(30) Foreign Application Priority Data

Feb. 10, 2023 (CN) ..... 202310108141.4

(51) Int. Cl.
*F25B 43/02* (2006.01)

(52) U.S. Cl.
CPC ..... *F25B 43/02* (2013.01); *F25B 2400/23* (2013.01)

(58) Field of Classification Search
CPC ..... F25B 43/02; F25B 43/006; F25B 43/00; F25B 2400/23; F25B 39/04; F25B 2339/04; F25B 2339/044; F25B 2339/0441; F25B 2339/0442; F25B 2339/0443; F25B 2339/0444; F25B 2339/0446; F25B 2339/046
See application file for complete search history.

(56) References Cited

U.S. PATENT DOCUMENTS

2013/0091892 A1* 4/2013 Nemit, Jr. ..... F04C 18/16 418/201.1
2021/0341191 A1 11/2021 Kontu et al.

FOREIGN PATENT DOCUMENTS

CN 100567857 C 12/2009
CN 202254541 U 5/2012
CN 102345944 B 3/2014
CN 106168423 A 11/2015
(Continued)

OTHER PUBLICATIONS

English translation of Gu et al. (CN 105571219 B) (Year: 2018).*
(Continued)

*Primary Examiner* — Miguel A Diaz
(74) *Attorney, Agent, or Firm* — Drew Folgmann

(57) ABSTRACT

Disclosed is an oil separation device for a condenser. The condenser comprises: a housing having an accommodating chamber; and an oil separation partition that divides the accommodating chamber into an oil separation chamber and a condensation chamber. The oil separation device comprises: a first refrigerant inlet port and a second refrigerant inlet port, for guiding refrigerant gas into the oil separation chamber; and a first refrigerant outlet port, a second refrigerant outlet port, and a third refrigerant outlet port, for guiding refrigerant gas separated from oil out of the oil separation chamber, wherein, the first refrigerant outlet port is arranged at or near the first end of the oil separation chamber, the second refrigerant outlet port is arranged at or near the second end of the oil separation chamber, the third refrigerant outlet port is arranged in or near the middle of the oil separation chamber.

17 Claims, 3 Drawing Sheets

(56) References Cited

FOREIGN PATENT DOCUMENTS

| | | | | | |
|---|---|---|---|---|---|
| CN | 205156445 | U | | 4/2016 | |
| CN | 105571219 | A | | 5/2016 | |
| CN | 107062709 | A | * | 8/2017 | ..... F25B 43/02 |
| CN | 107367092 | A | | 11/2017 | |
| CN | 207379116 | U | | 5/2018 | |
| CN | 208059364 | U | | 11/2018 | |
| CN | 105571219 | B | * | 12/2018 | ..... F25B 43/02 |
| CN | 208504803 | U | | 2/2019 | |
| CN | 107367092 | B | | 7/2019 | |
| CN | 110006195 | A | * | 7/2019 | ..... F25B 43/02 |
| CN | 211345950 | U | | 8/2020 | |
| CN | 211823302 | U | | 10/2020 | |
| CN | 113606826 | A | | 11/2021 | |
| JP | H10-62039 | A | | 3/1998 | |
| JP | 2017075776 | A | | 4/2017 | |

OTHER PUBLICATIONS

English translation of Yang et al. (CN 107062709 A) (Year: 2017).*
English translation of Zhejiang Sanhua Intelligent Control Co., Ltd. (CN 110006195 A) (Year: 2019).*
Extended European Search Report received for EP Application No. 24156416.0, mailed on May 28, 2024, 8 Pages.

* cited by examiner

OIL SEPARATION DEVICE FOR CONDENSER, CONDENSER HAVING IT AND REFRIGERATION SYSTEM

CROSS REFERENCE TO RELATED APPLICATIONS

This application claims priority to CN Patent Application No. 202310108141.4 filed Feb. 10, 2023, which is incorporated by reference herein in its entirety.

FIELD OF THE INVENTION

The disclosure relates to the technical field of heat exchange equipment, in particular to an oil separation device for a condenser, and further to a condenser configured with the oil separation device and a refrigeration system configured with the condenser.

BACKGROUND OF THE INVENTION

Compressors, especially screw compressors, are widely used in refrigeration systems due to their advantages of large capacity, high unit efficiency, and great reliability. The screw compressor has a relatively fast rotational speed and generates more heat during use. Lubricating oil can take away the heat generated by compression from the compressor, and also has functions such as sealing, lubrication, and noise reduction. The mixture of gaseous refrigerant and oil droplets discharged by the screw compressor will form an oil film on the tube wall of the heat exchanger if the oil droplets are not separated. The thermal conductivity of the oil film is very small, which will greatly reduce the heat transfer efficiency of the heat exchanger, such as the condenser, thus reducing the refrigeration efficiency. Therefore, current condensers are usually equipped with oil separation devices. As shown in FIGS. 1 and 2, the oil separation device 20 is arranged inside the housing of the condenser 10 to facilitate the separation of lubricating oil and gaseous refrigerant. As can be seen from the arrows in FIG. 1, the refrigerant gas enters the oil separation chamber 21 from the inlet port 22, flows towards the middle, passes through the filter screen 23, and then leaves the oil separation chamber 21 from the outlet port 24 in the middle to enter the condensation chamber 11 for heat exchange. However, as the quantity of flow and velocity of coolant/gaseous refrigerant increase, once the critical velocity is exceeded, the efficiency of oil separation will be significantly reduced. On the one hand, if the cross-sectional area of the oil separation chamber is designed to be larger in pursuit of better oil separation efficiency, it will occupy too much of the internal volume of the condenser and reduce the space of the condensation chamber. On the other hand, if the space of the condensation chamber cannot be reduced, the size of the condenser must be designed to be larger, which will lead to very high manufacturing cost of the entire condenser.

SUMMARY OF THE INVENTION

In view of the above an oil separation device for a condenser is provided, so as to solve or at least alleviate one or more of the aforementioned problems and problems in other aspects existing in the prior art, or to provide an alternative technical solution for the prior art.

An oil separation device for a condenser is provided, the condenser comprising: a housing having an accommodating chamber; and an oil separation partition arranged inside the housing and extending along a length direction of the housing, where the oil separation partition divides the accommodating chamber into an oil separation chamber and a condensation chamber, and the oil separation chamber has a first end and a second end along its length direction, wherein the oil separation device comprises:

a first refrigerant inlet port and a second refrigerant inlet port, arranged on the housing for guiding refrigerant gas into the oil separation chamber; and a first refrigerant outlet port, a second refrigerant outlet port, and a third refrigerant outlet port, arranged on the housing for guiding refrigerant gas separated from oil out of the oil separation chamber, wherein, the first refrigerant outlet port is arranged at or near the first end of the oil separation chamber, the second refrigerant outlet port is arranged at or near the second end of the oil separation chamber, the third refrigerant outlet port is arranged in or near the middle of the oil separation chamber, while the first refrigerant inlet port is arranged between the first refrigerant outlet port and the third refrigerant outlet port, and the second refrigerant inlet port is arranged between the second refrigerant outlet port and the third refrigerant outlet port.

In an embodiment of an oil separation device for a condenser, a filter screen is provided at or near the first refrigerant outlet port, the second refrigerant outlet port, and the third refrigerant outlet port, respectively, wherein the filter screen is arranged perpendicular to the length direction of the housing in the oil separation chamber, so that the refrigerant gas is capable of flowing through the filter screen to reach the first refrigerant outlet port, the second refrigerant outlet port, and the third refrigerant outlet port.

In an embodiment of an oil separation device for a condenser, the first refrigerant inlet port and the second refrigerant inlet port are provided with a baffle, respectively.

In an embodiment of an oil separation device for a condenser, size and shape of a cross section of the first refrigerant inlet port and that of the second refrigerant inlet port are the same, and size and shape of a cross section of the first refrigerant outlet port and that of the second refrigerant outlet port are the same.

In an embodiment of an oil separation device for a condenser, the filter screen is made of steel wire mesh.

In an embodiment of an oil separation device for a condenser, the oil separation partition is at an angle with a horizontal plane, where the angle is within the range of 0° to 90°.

In an embodiment of an oil separation device for a condenser, a length of the oil separation chamber along its length direction is the same or substantially the same as a length of the housing along its length direction.

In an embodiment of an oil separation device for a condenser, the first refrigerant inlet port, the second refrigerant inlet port, the first refrigerant outlet port, the second refrigerant outlet port, and the third refrigerant outlet port are made of steel; and/or are fixed to the housing by welding, or integrally formed with the housing.

In an embodiment of an oil separation device for a condenser, the first refrigerant inlet port and the second refrigerant inlet port are symmetrically arranged relative to a centerline of the oil separation chamber.

In an embodiment of an oil separation device for a condenser, the oil separation device further comprises a fourth refrigerant outlet port, wherein the fourth refrigerant outlet port is arranged in or near the middle of the oil separation chamber, and the third refrigerant outlet port and the fourth refrigerant outlet port are symmetrically arranged relative to the centerline of the oil separation chamber.

In an embodiment of an oil separation device for a condenser, the oil separation device further comprises a partition plate arranged perpendicular to the length direction of the housing in the middle of the oil separation chamber, so that the third refrigerant outlet port is located on one side of the partition plate, and the fourth refrigerant outlet port is located on the other side of the partition plate.

In addition, a condenser is also provided, which is configured with the oil separation device for a condenser as described above.

Furthermore, a refrigeration system is further provided, which is configured with the aforementioned condenser, a compressor, a throttling device, and an evaporator connected into a loop.

In an embodiment of a refrigeration system, the compressor is a screw compressor.

It can be appreciated that the oil separation device for a condenser divides the gaseous refrigerant entering the condenser into four gas flow streams and guides them from the oil separation chamber into the condensation chamber. In this way, not only the flow velocity of the refrigerant gas can be significantly reduced, but also a better oil separation effect can be achieved without occupying too much internal volume of the condenser.

BRIEF DESCRIPTION OF THE DRAWINGS

The technical solution will be described in further detail below in conjunction with the accompanying drawings and embodiments. However, it should be noted that these drawings are only designed for explanatory purposes and are intended to conceptually illustrate the structure described herein, without the need to be drawn proportionally.

DETAILED DESCRIPTION OF EMBODIMENT(S) OF THE INVENTION

The content of the disclosure and the differences between the disclosure and the prior art can be understood by referring to the accompanying drawings and the text. The technical solution will be described in further detail below through the accompanying drawings and by enumerating some optional embodiments.

It should be noted that any technical features or solutions in the embodiments are one or several of multiple optional technical features or technical solutions. For brevity, it is neither possible to exhaustively enumerate herein all alternative technical features and technical solutions of the invention, nor is it possible to emphasize that the implementation of each technical feature is one of the optional multiple implementations. Therefore, those skilled in the art should be aware that any technical means provided by the invention can be substituted, or any two or more technical means or technical features provided by the invention can be combined with each other to obtain a new technical solution.

Any technical feature or technical solution within the embodiments does not limit the scope of protection of the invention. The scope of protection of the invention should include any alternative technical solutions that those skilled in the art can think of without creative labor, as well as any new technical solutions obtained by those skilled in the art by combining any two or more technical means or technical features provided by the invention.

Figure 1:
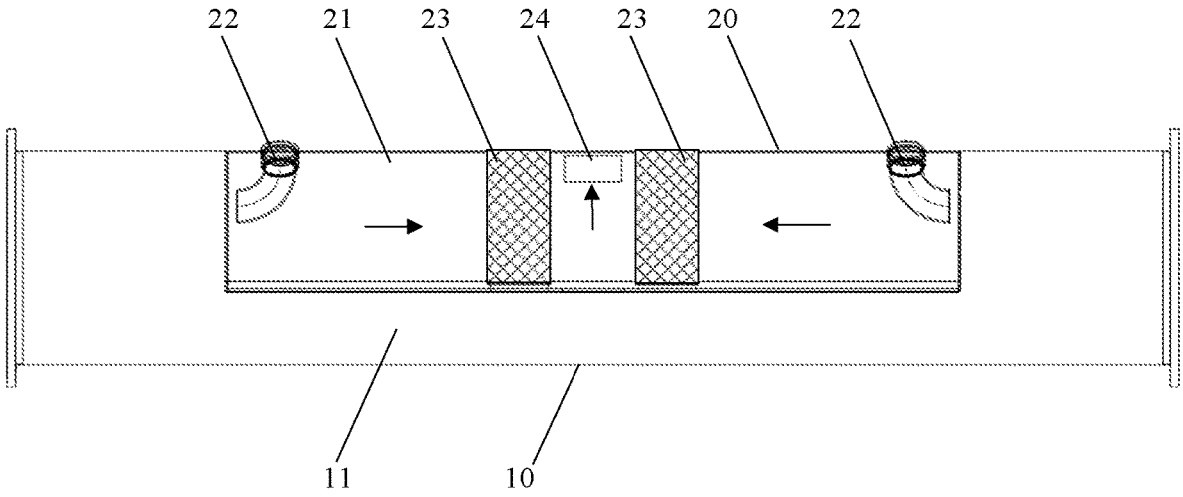
FIG. 1 is a structural schematic diagram of a condenser having an oil separation device in the prior art.
Figure 2:
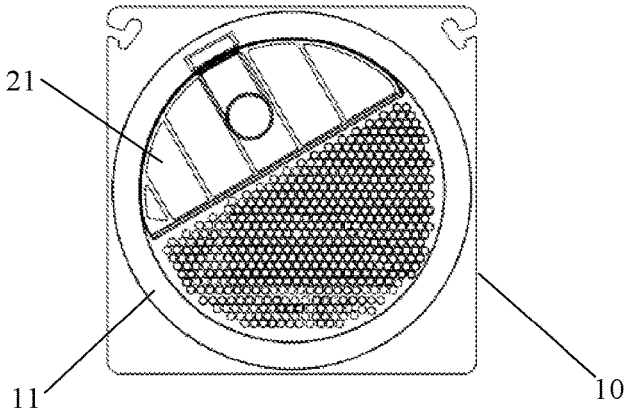
FIG. 2 is a cross-sectional view of the condenser having an oil separation device as shown in FIG. 1.
Figure 3:
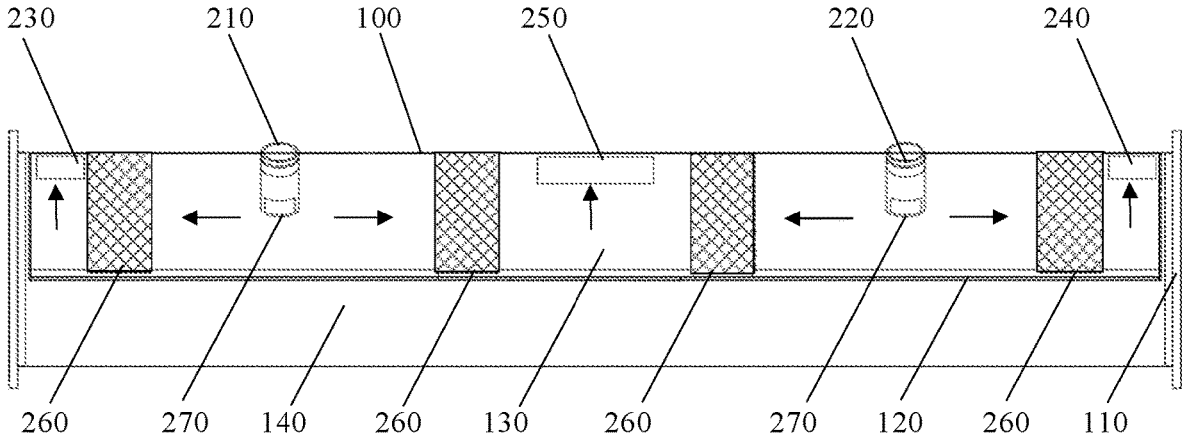
FIG. 3 is a structural schematic diagram of an embodiment of a condenser having an oil separation device ntion.
Figure 4:
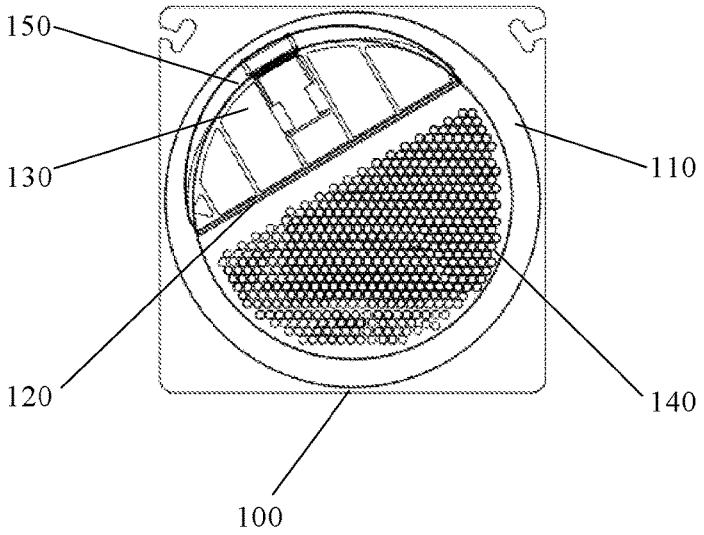
FIG. 4 is a cross-sectional view of the embodiment of a condenser having an oil separation device as shown in FIG. 3.

FIG. 3 schematically illustrates the structure of an embodiment of an oil separation device for a condenser. As can be clearly seen from FIGS. 3 and 4, the condenser 100 comprises a housing 110 having an accommodating chamber and an oil separation partition 120. The oil separation partition 120 is arranged inside the housing 110 and extends along the length direction of the housing 110. The oil separation partition 120 divides the accommodating chamber into an oil separation chamber 130 and a condensation chamber 140 having several heat exchange tubes. The oil separation chamber 130 has a first end and a second end along its length direction. In order to enhance the oil separation effect, the oil separation chamber 130 can also be additionally configured with a top plate 150, where the shape of the top plate 150 can match the shape of the inner wall of the accommodating chamber of the housing 110. Specifically, the housing 110 has a substantially cylindrical accommodating chamber, and the top plate 150 can be designed with an arc surface shape accordingly, as shown in FIG. 4. Those skilled in the art are aware that the main function of the shell and tube condenser currently used in water-cooled HVAC (Heating Ventilation Air Conditioning) equipment is to condense the high-temperature and high-pressure refrigerant gas discharged from the compressor (not shown) into a medium-temperature and high-pressure refrigerant liquid.

With continued reference to FIGS. 3 and 4, the oil separation device 200 consists of a first refrigerant inlet port 210, a second refrigerant inlet port 220, a first refrigerant outlet port 230, a second refrigerant outlet port 240, a third refrigerant outlet port 250, and other components. The first refrigerant inlet port 210 and the second refrigerant inlet port 220 are provided on the housing 110 for guiding high-temperature and high-pressure refrigerant gas from the compressor into the oil separation chamber 130. The first refrigerant outlet port 230, the second refrigerant outlet port 240, and the third refrigerant outlet port 250 are provided on the housing 110, so that the gaseous refrigerant separated from the lubricating oil flows from the oil separation chamber 130 into the condensation chamber 140. The first refrigerant outlet port 230 is arranged at or near the first end of the oil separation chamber 130, the second refrigerant outlet port 240 is arranged at or near the second end of the oil separation chamber 130, the third refrigerant outlet port 250 is arranged in or near the middle of the oil separation chamber 130, while the first refrigerant inlet port 210 is arranged between the first refrigerant outlet port 230 and the third refrigerant outlet port 250, and the second refrigerant inlet port 220 is arranged between the second refrigerant outlet port 240 and the third refrigerant outlet port 250.

According to the oil separation device for a condenser, the refrigerant gas flow entering the oil separation chamber of the condenser can be divided into four gas flow streams: the first refrigerant outlet port and the second refrigerant outlet port each account for 25% of the gas flow, and the third refrigerant outlet port accounts for 50% of the gas flow, as shown by the arrows in FIG. 3. It is easy to understand that, the third refrigerant outlet port 250 can be divided into two outlets, each accounting for 25% of the gas flow and corresponding to the first refrigerant outlet port 230 and the second refrigerant outlet port 240, respectively. Compared with the prior art, the flow velocity of the refrigerant gas flow entering the condenser can be reduced by at least half, far below the critical flow velocity, which is conducive to achieving a better oil separation effect. At the same time, there is no need to increase the size of the oil separation chamber or occupy too much internal space of the condenser, which can reduce the size of the condenser while meeting the requirement for oil separation effect.

In combination with the above embodiments, in other optional embodiments, one or more filter screens 260 are respectively arranged at or near the first refrigerant outlet port 230, the second refrigerant outlet port 240, and the third refrigerant outlet port 250. The filter screens 260 are arranged perpendicular or horizontal to the length direction of the housing 110 inside the oil separation chamber 130, allowing the refrigerant gas to flow through the filter screens 260 to reach the first refrigerant outlet port 230, the second refrigerant outlet port 240, and the third refrigerant outlet port 250. It should be noted that the filter screens 260 can be made of steel wire mesh and provided with a plurality of filtering holes, where the diameter of the filtering holes is, for example, less than or equal to 0.3 mm. It should be further elaborated that the filter screens adopt a fine steel wire mesh. Specifically, the cylindrical filter screens formed by fine steel wire mesh can effectively separate oil droplets in the refrigerant gas flow. Of course, the diameter of the filtering hole is not limited to being less than or equal to 0.3 mm. And, the size of the filter screen can be designed according to specific needs by selecting steel wire meshes with different pore sizes. Its purpose does not deviate from the design concept, and should fall within the scope of protection of the invention.

In the embodiment shown in FIG. 3, the first refrigerant inlet port 210 and the second refrigerant inlet port 220 are respectively provided with a baffle 270 to reduce the impact force of the high-temperature and high-pressure gas from the exhaust pipe of the compressor, and preliminarily intercept some oil droplets in the refrigerant gas.

In order to quickly deposit the filtered lubricating oil to the bottom of the oil separation chamber 130, the oil separation partition 120 can be designed at an angle with the horizontal plane, where the angle is within the range of 0° to 90°, as shown in FIG. 4.

For manufacturing convenience, the size and shape of the cross section of the first refrigerant inlet port 210 and that of the second refrigerant inlet port 220 are the same, and the size and shape of the cross section of the first refrigerant outlet port 230 and that of the second refrigerant outlet port 240 are the same. In addition, the first refrigerant inlet port 210, the second refrigerant inlet port 220, the first refrigerant outlet port 230, the second refrigerant outlet port 240, and the third refrigerant outlet port 250 are made of steel; and/or are fixed to the housing 110 by welding or other means, or are integrally formed with the housing 110. Furthermore, the first refrigerant inlet port 210 and the second refrigerant inlet port 220 can be designed to be symmetrically arranged relative to the centerline of the oil separation chamber 130.

Figure 5:
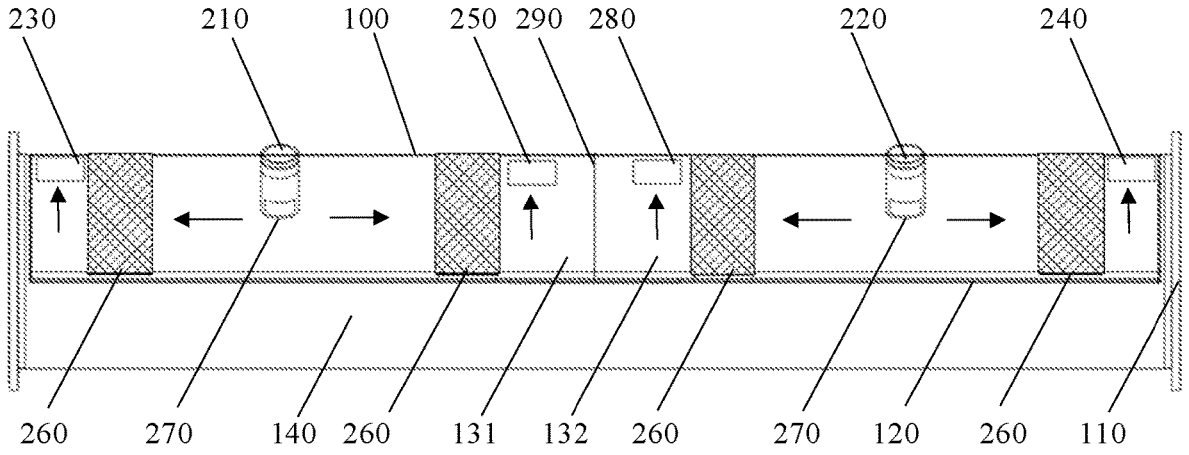
FIG. 5 is a structural schematic diagram of another embodiment of a condenser having an oil separation device.

As an example, the length of the oil separation chamber 130 along its length direction is the same or substantially the same as the length of the housing 110 along its length direction, as shown in FIG. 3. This can make the cross-sectional area of the oil separation chamber smaller, thereby reducing the overall size of the condenser. As another example, the oil separation device 200 may also comprise a fourth refrigerant outlet port 280, which is located in or near the middle of the oil separation chamber 130, and the third refrigerant outlet port 250 and the fourth refrigerant outlet port 280 are symmetrically arranged relative to the centerline of the oil separation chamber 130. As can be seen from the arrows in FIG. 5, when the refrigerant gas enters the first chamber 131 from the first refrigerant inlet port 210, it is divided into two gas flow streams that flow out from the first refrigerant outlet port 230 and the third refrigerant outlet port 250, respectively. And, when the refrigerant gas enters the second chamber 132 from the second refrigerant inlet port 220, it is divided into two gas flow streams that flow out from the second refrigerant outlet port 240 and the fourth refrigerant outlet port 280, respectively. That is to say, the first refrigerant outlet port 230, the second refrigerant outlet port 240, the third refrigerant outlet port 250, and the fourth refrigerant outlet port 280 each account for 25% of the gas flow, and the first refrigerant outlet port 230 corresponds to the third refrigerant outlet port 250, and the second refrigerant outlet port 240 corresponds to the fourth refrigerant outlet port 280. Further, the oil separation device 200 further comprises a partition plate 290, which is arranged perpendicular to the length direction of the housing 110 in the middle of the oil separation chamber, separating the oil separation chamber 130 into relatively independent first chamber 131 and second chamber 132, so that the third refrigerant outlet port 250 is located on one side of the partition plate 290, and the fourth refrigerant outlet port 280 is located on the other side of the partition plate 290. This ensures that the refrigerant gas flowing out from the third refrigerant outlet port 250 and the refrigerant gas flowing out from the fourth refrigerant outlet port 280 do not interfere with each other.

In addition, a condenser configured with the aforementioned oil separation device is disclosed. Since the oil separation device is arranged inside the condenser, the oil separation effect is greatly improved without occupying too much internal space of the condenser. Through experimental verification, new refrigerants such as hydrofluoroolefin (HFO), due to their lower critical velocities, are particularly suitable for use in condensers configured with the aforementioned oil separation device.

Furthermore, the invention also provides a refrigeration system configured with the aforementioned condenser, wherein the refrigeration system comprises a cooling tower, a chiller unit, and a pumping device, etc. connected by pipelines. Wherein, the chiller unit is composed of components such as a compressor, a condenser, a throttling device, and an evaporator connected into a loop. For example, the compressor can be a screw compressor. As mentioned earlier, condensers configured with the aforementioned oil separation device have a better oil separation effect, which is conducive to further improving the heat transfer effect. Therefore, it is highly recommended to apply the aforementioned condenser to various refrigeration systems.

If terms such as "first" and "second" are used herein to limit components, those skilled in the art should be aware that the use of "first" and "second" is only for the convenience of describing and distinguishing components. Unless otherwise stated, the above terms do not have any special meanings.

In addition, as to the terms used to indicate positional relationships or shapes in any of the technical solutions disclosed in the invention, unless otherwise stated, the implications thereof include states or shapes that are approximate, similar, or close to them. Any component provided by the invention can be either assembled from multiple individual components or manufactured as a separate component using an integration process.

If terms such as "center", "longitudinal", "transverse", "front", "back", "left", "right", "vertical", "horizontal", "top", "bottom", "inside", "outside", etc. are used in the depiction of the invention, the orientations or positional relationships indicated by the above terms are based on the orientations or positional relationships shown in the drawings. These terms are used merely for the convenience of describing the invention and simplifying the description, rather than indicating or implying that the device, mechanism, component or element referred to must have a specific orientation, be constructed and operated in a specific orientation, so they cannot be understood as forming limitations on the scope of protection of the invention.

Last, it should be noted that the above embodiments are only used to illustrate the technical solution of the invention but not to limit it. Although the invention has been described in detail with reference to preferred embodiments, those skilled in the art, however, should understand that the specific embodiments of the invention can still be modified or some technical features can be equivalently substituted. Without departing from the spirit of the technical solution of the invention, all of these modified embodiments or technical features used for equivalent substitution should fall within the scope of the claimed technical solution of the invention.

What is claimed is:

1. An oil separation device for a condenser, the condenser comprising: a housing having an accommodating chamber; and an oil separation partition arranged inside the housing and extending along a length direction of the housing, where the oil separation partition divides the accommodating chamber into an oil separation chamber and a condensation chamber, and the oil separation chamber has a first end and a second end along its length direction, wherein the oil separation device comprises:

a first refrigerant inlet port and a second refrigerant inlet port, arranged on the housing for guiding refrigerant gas into the oil separation chamber; and a first refrigerant outlet port, a second refrigerant outlet port, a third refrigerant outlet port, and a fourth refrigerant outlet port, arranged on the housing for guiding refrigerant gas separated from oil out of the oil separation chamber, wherein, the first refrigerant outlet port is arranged at the first end of the oil separation chamber, the second refrigerant outlet port is arranged at the second end of the oil separation chamber, the third refrigerant outlet port is arranged in a middle of the oil separation chamber, while the first refrigerant inlet port is arranged between the first refrigerant outlet port and the third refrigerant outlet port, and the second refrigerant inlet port is arranged between the second refrigerant outlet port and the third refrigerant outlet port, wherein the fourth refrigerant outlet port is arranged in the middle of the oil separation chamber, and the third refrigerant outlet port and the fourth refrigerant outlet port are symmetrically arranged relative to a centerline of the oil separation chamber.

2. The oil separation device for a condenser according to claim 1, wherein a filter screen is provided at the first refrigerant outlet port, the second refrigerant outlet port, and the third refrigerant outlet port, respectively, wherein each filter screen is arranged perpendicular to the length direction of the housing in the oil separation chamber, so that the refrigerant gas is capable of flowing through each filter screen to reach the first refrigerant outlet port, the second refrigerant outlet port, and the third refrigerant outlet port.

3. The oil separation device for a condenser according to claim 2, wherein the first refrigerant inlet port and the second refrigerant inlet port are provided with a baffle, respectively.

4. The oil separation device for a condenser according to claim 1, wherein a size and shape of a cross section of the first refrigerant inlet port and that of the second refrigerant inlet port are the same, and a size and shape of a cross section of the first refrigerant outlet port and that of the second refrigerant outlet port are the same.

5. The oil separation device for a condenser according to claim 1, wherein each filter screen is made of steel wire mesh.

6. The oil separation device for a condenser according to claim 1, wherein the oil separation partition is at an angle with a horizontal plane, where the angle is within the range of 0° to 90°.

7. The oil separation device for a condenser according to claim 1, wherein a length of the oil separation chamber along its length direction is the same or substantially the same as a length of the housing along its length direction.

8. The oil separation device for a condenser according to claim 1, wherein the first refrigerant inlet port, the second refrigerant inlet port, the first refrigerant outlet port, the second refrigerant outlet port, and the third refrigerant outlet port are made of steel, are fixed to the housing by welding, or are integrally formed with the housing.

9. The oil separation device for a condenser according to claim 1, wherein the first refrigerant inlet port and the second refrigerant inlet port are symmetrically arranged relative to a centerline of the oil separation chamber.

10. The oil separation device for a condenser according to claim 1, wherein the oil separation device further comprises a partition plate arranged perpendicular to the length direction of the housing in the middle of the oil separation chamber, so that the third refrigerant outlet port is located on one side of the partition plate, and the fourth refrigerant outlet port is located on the other side of the partition plate.

11. A refrigeration system, wherein the refrigeration system is configured with the oil separation device according to claim 1.

12. An oil separation device for a condenser, wherein the oil separation device comprises:

a first refrigerant inlet port and a second refrigerant inlet port, arranged on a housing for guiding refrigerant gas into an oil separation chamber;

a first refrigerant outlet port, a second refrigerant outlet port, a third refrigerant outlet port, and a fourth refrigerant outlet port, arranged on the housing for guiding refrigerant gas separated from oil out of the oil separation chamber; and wherein the third refrigerant outlet port and the fourth refrigerant outlet port are symmetrically arranged relative to a centerline of the oil separation chamber.

13. The oil separation device according to claim 12, wherein the fourth refrigerant outlet port is arranged in a middle of the oil separation chamber.

14. The oil separation device according to claim 12, wherein a partition plate is arranged between the third refrigerant outlet port and the fourth refrigerant outlet port.

15. The oil separation device according to claim 12, wherein a partition plate is arranged between the third refrigerant outlet port and the fourth refrigerant outlet port.

16. The oil separation device according to claim 15, wherein the first refrigerant outlet port and the second refrigerant outlet port are arranged outside of the first refrigerant inlet port and the second refrigerant inlet port.

17. An oil separation device for a condenser, wherein the oil separation device comprises:

a first refrigerant inlet port and a second refrigerant inlet port, arranged on a housing for guiding refrigerant gas into an oil separation chamber;

a first refrigerant outlet port, a second refrigerant outlet port, a third refrigerant outlet port, and a fourth refrigerant outlet port, arranged on the housing for guiding refrigerant gas separated from oil out of the oil separation chamber; and wherein the third refrigerant outlet port and the fourth refrigerant outlet port are arranged between the first refrigerant inlet port and the second refrigerant inlet port.

* * * * *